United States Patent [19]

Wojcik

[11] 4,034,883

[45] July 12, 1977

[54] CLOSURE LID FOR HOME CANNING JAR

[76] Inventor: Walter J. Wojcik, 14799 Milan Oakville Road, Milan, Mich. 48160

[21] Appl. No.: 711,112

[22] Filed: Aug. 3, 1976

[51] Int. Cl.[2] ..... B65D 45/02

[52] U.S. Cl. ..... 215/276; 215/260; 215/270

[58] Field of Search ..... 215/260, 270, 276

[56] References Cited

U.S. PATENT DOCUMENTS

| | | | |
|---|---|---|---|
| 184,478 | 11/1876 | Otterson | 215/276 |
| 653,262 | 7/1900 | Rodiger | 215/276 |
| 661,746 | 11/1900 | Simpson | 215/276 |
| 3,434,615 | 3/1969 | Barletta | 215/276 |
| 3,924,772 | 12/1975 | Magnani | 215/276 |

*Primary Examiner*—Ro E. Hart
*Attorney, Agent, or Firm*—Allen D. Brufsky

[57] ABSTRACT

A closure lid for a home canning jar includes a cap member threadably engaging the neck of a canning jar. A flexible dome shaped body extends upwardly through the cap member. A mechanism is provided for forming an airtight seal between the cap and the body. A mechanism is provided for forming an airtight seal between the body and an upper edge of the neck of the jar.

5 Claims, 5 Drawing Figures

CLOSURE LID FOR HOME CANNING JAR

BACKGROUND OF THE INVENTION

A number of United States Patents relate to closure lids for home canning jars, but these aforementioned patents are non-applicable to my present invention. These patents are; U.S. Pat. Nos. 1,716,851 to Hammer; 2,046,227 to White; 3,227,302 to Merrill; and 3,373,889 to Giles.

SUMMARY OF THE INVENTION

My present invention relates to a plastic closure lid for home canning jars.

An object of my present invention is to provide an improved closure lid for a home canning jar, wherein the closure lid is formed from a plastic and has a vacuum indicator included therein. Briefly, my present invention comprises a cap member adapted to be threadably received to the neck of a canning jar. A flexible dome shaped body extends upwardly through the cap member. A mechanism is provided for forming an airtight seal between the cap and the body. A mechanism is provided for forming an airtight seal between the body and an upper edge of the neck of the jar.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
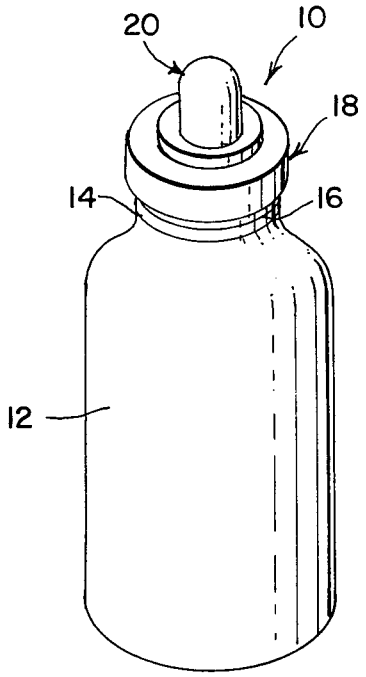
FIG. 1 illustrates a perspective view of a closure lid on a home canning jar.

Turning now descriptively to the drawings, in which similar reference characters denote similar elements throughout the several views, FIG. 1 shows a closure lid 10 for a canning jar 12 having a neck 14 with external threads 16 thereon. The lid 10 comprises a sealing cap 18 and a flexible dome shaped body 20.

Figure 4:
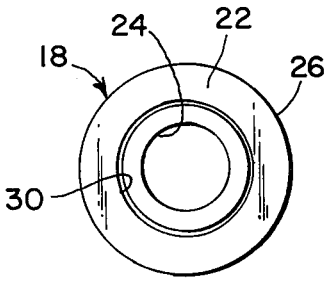
FIG. 4 illustrates a top view of a cap of the lid.
Figure 5:
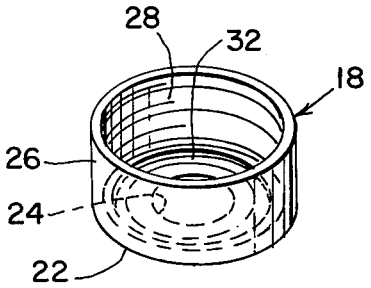
FIG. 5 illustrates a bottom perspective view of the cap.

The cap 18 as shown in FIGS. 4, 5 comprises a top 22 having an enlarged central circularly shaped opening 24 therethrough, and a downwardly extending outer annular skirt 26 having an internal threaded surface 28. The upper surface of the top 22 has an annular groove 30 therein. The lower surface of the top 22 has an annular channel 32 therein.

Figure 2:
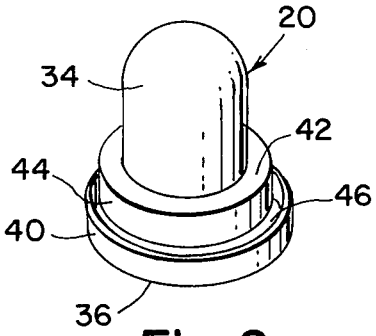
FIG. 2 illustrates a perspective view of a flexible dome shaped body of the lid.
Figure 3:
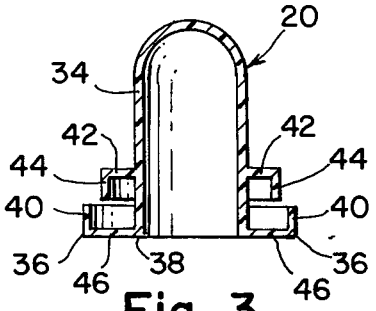
FIG. 3 illustrates a side cross sectional view of the body.

The body 20 as shown in FIGS. 2, 3 comprises a central dome shaped portion 34 having an outwardly extending L-shaped annular flange member 36 affixed to the lower annular peripherial edge 38 of portion 34, wherein the shorter outer leg 40 of flange member 37 extends upwardly. An L-shaped annular portion 42 is affixed to the outer peripherial surface of the portion 34, wherein portion 42 is disposed above member 36. The shorter leg 44 of portion 42 extends downwardly towards member 36.

In use, the dome shaped portion 34 of body 20 extends upwardly through opening 24 of cap 18. The shorter leg 44 of portion 42 engages into groove 30. The shorter leg 40 of flange member 36 engages into channel 32 as the longer leg 46 of flange member 36 forms an air tight seal with the upper edge of neck 14 of jar 12. Flange member 36 and portion 42 hold the outer peripherial surface of portion 34 in an air tight seal against the peripherial edge of opening 24 of the top 22.

The cap 18 is formed from a semirigid thermoplastic selected from the group consisting of polyethylene having a density of at least 0,917g/cc$^3$, polypropylene, nylon, polystyrene, or polyvinyl chloride. The body 20 is formed from an ethylene vinyl acetate copolymer having a vinyl acetate content of at least 8 percent thereby allowing the top of center portion 34 to be depressed downwardly by the applied vacuum. This depression of the center portion 34 functions as a visual indicator that vacuum has been applied.

Since obvious changes may be made in the specific embodiment of the invention described herein, such modifications being with the spirit and scope of the invention claimed, it is indicated that all matter contained herein is intended as illustrative and not as limiting in scope.

Having thus described the invention, what I claim as new and desire to secure by Letters Patent of the United States is:

1. A closure lid adapted to be threadably received on an externally threaded neck of a canning jar, which comprises;

a. a cap member adapted to be threadably received on said external threaded neck;

b. a flexible dome shaped body extending upwardly through said cap member;

c. first means for forming an air tight seal between said cap and said body;

d. second means for forming an air tight seal between said body and an upper edge of said neck of said jar;

e. said cap further includes a top having an enlarged central opening therethrough, an upper surface of said top having an annular groove therein, a lower surface of said top having an annular channel therein, said opening receiving said flexible dome shaped body therethrough, and an annular skirt having internal threads, said skirt affixed to an outer annular edge of said top and extending downwardly therefrom, said skirt adapted to threadably engage said neck.

2. A lid according to claim 1, wherein said second means further comprises:

a. a center dome shaped portion of said body;

b. an outwardly extending L-shaped flange member affixed to a lower peripherial edge of said center dome shaped portion, a shorter leg of said flange member engaging into said annular channel of said top, and a longer leg of said flange member adapted to form said air tight seal with said upper edge of said neck of said jar.

3. A lid according to claim 2, wherein said first means further comprises an L-shaped annular portion affixed to an outer peripherial surface of said center dome shaped portion, a shorter leg of said L-shaped portion engaging into said annular grove of said top.

4. A lid according to claim 1, wherein said top is formed from a plastic selected from the group consisting of polyethylene, polypropylene, polystyrene, nylon, or polyvinyl chloride.

5. A lid according to claim 1, wherein said body is formed from a polyethylene vinyl acetate having a vinyl acetate content of at least eight percent.

* * * * *